US008649986B2

(12) United States Patent
Lieftucht et al.

(10) Patent No.: US 8,649,986 B2
(45) Date of Patent: Feb. 11, 2014

(54) PROCESS FOR PREDICTING THE EMERGENCE OF LONGITUDINAL CRACKS DURING CONTINUOUS CASTING

(75) Inventors: Dirk Lieftucht, Ledgen (DE); Markus Reiferscheid, Korschenbroich (DE); Matthias Arzberger, Mülheim (DE)

(73) Assignee: SMS Siemag AG, Düsseldorf (DE)

( * ) Notice: Subject to any disclaimer, the term of this patent is extended or adjusted under 35 U.S.C. 154(b) by 252 days.

(21) Appl. No.: 12/997,778

(22) PCT Filed: Apr. 30, 2009

(86) PCT No.: PCT/DE2009/000617

§ 371 (c)(1),
(2), (4) Date: Feb. 22, 2011

(87) PCT Pub. No.: WO2009/149680

PCT Pub. Date: Dec. 17, 2009

(65) Prior Publication Data

US 2011/0144926 A1 Jun. 16, 2011

(30) Foreign Application Priority Data

Jun. 13, 2008 (DE) ..... 10 2008 028 481

(51) Int. Cl.
*G01B 21/30* (2006.01)

(52) U.S. Cl.
USPC ..... 702/35; 702/34; 702/130

(58) Field of Classification Search
USPC ..... 164/151.5, 151.4, 154.1, 150.1; 700/146, 31, 30; 702/35, 34, 75, 99, 702/130, 136, 179, 181
See application file for complete search history.

(56) References Cited

U.S. PATENT DOCUMENTS

| | | | | |
|---|---|---|---|---|
| 4,774,998 | A * | 10/1988 | Matsushita et al. | 164/453 |
| 5,904,202 | A * | 5/1999 | Adamy | 164/151.5 |
| 6,179,041 | B1 | 1/2001 | Pleschiutschnigg | |
| 6,564,119 | B1 * | 5/2003 | Vaculik et al. | 700/146 |
| 6,885,907 | B1 * | 4/2005 | Zhang et al. | 700/146 |

FOREIGN PATENT DOCUMENTS

| | | |
|---|---|---|
| DE | 34 23 475 | 11/1984 |
| DE | 198 43 033 | 3/2000 |
| DE | 101 08 730 | 9/2002 |
| DE | 10 2005 022922 | 12/2005 |
| EP | 0 885 675 | 12/1998 |
| JP | 56 095461 | 8/1981 |

(Continued)

OTHER PUBLICATIONS

Zhang Y. et al., "Industrial application of multivariate SPC to continuous caster start-up operations for breakout prevention", Control Engineering Practice, Pergamon Press, 1357-1376, Nov. 1, 2006.

*Primary Examiner* — Jonathan C Teixeira Moffat
*Assistant Examiner* — Stephanie Bloss
(74) *Attorney, Agent, or Firm* — Cozen O'Connor

(57) ABSTRACT

A process for predicting longitudinal cracks during continuous casting of steel slabs. The local strand temperature is measured by thermocouples distributed in the mold wall. In this process, the risk of the strand rupturing as a result of longitudinal cracking is assessed statistically taking into account the current temperature values measured by the thermocouples arranged in the mold and the temperature values determined when no cracks are present.

7 Claims, 1 Drawing Sheet

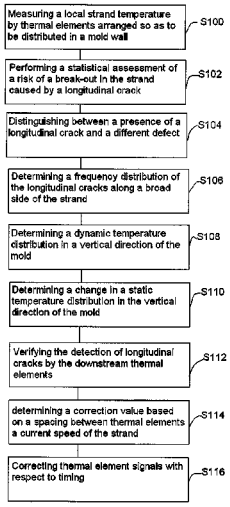

(56) References Cited

FOREIGN PATENT DOCUMENTS

| | | |
|---|---|---|
| JP | 62192243 | 8/1987 |
| JP | 1-210160 | 8/1989 |
| JP | 11 090599 | 4/1999 |
| JP | 2003-029538 | 1/2003 |
| WO | WO 00/05013 | 2/2000 |
| WO | WO 2004/082869 | 9/2004 |

* cited by examiner

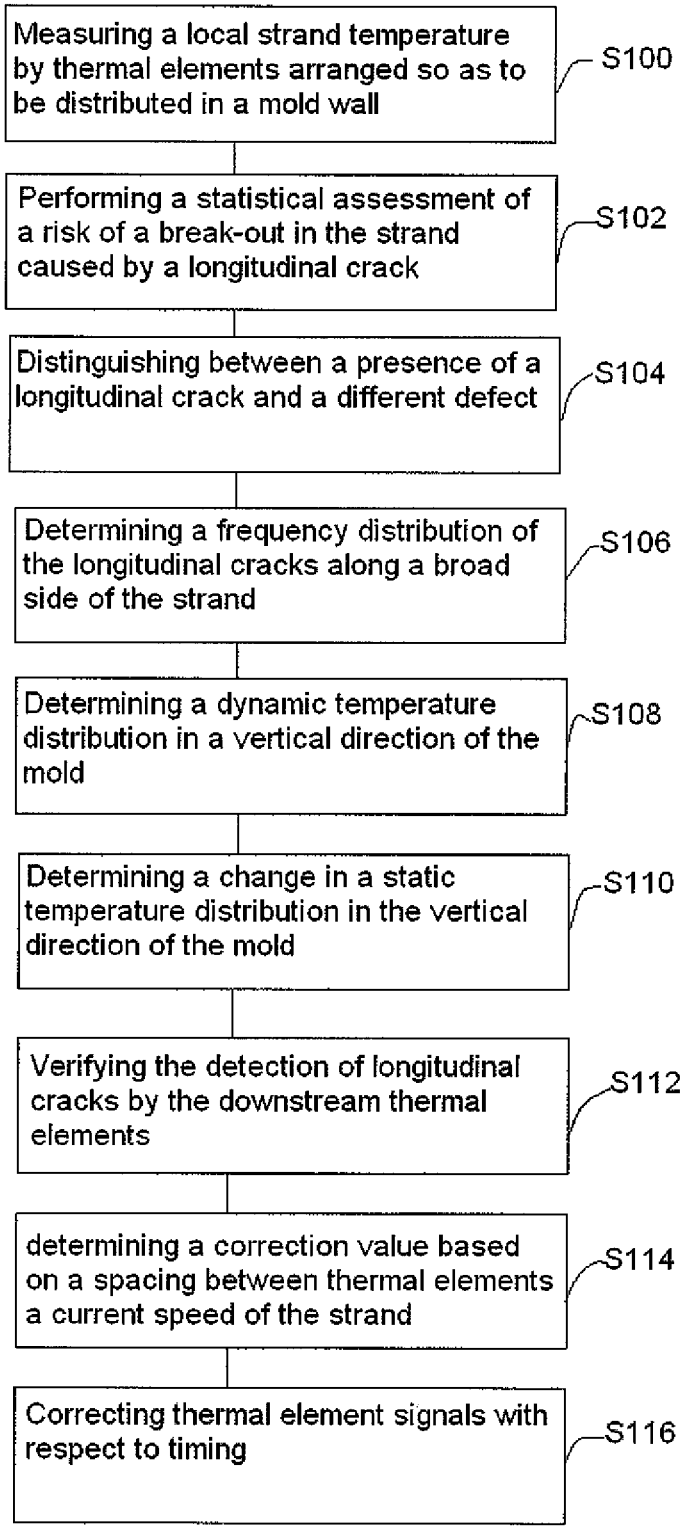
Measuring a local strand temperature by thermal elements arranged so as to be distributed in a mold wall
S100
Performing a statistical assessment of a risk of a break-out in the strand caused by a longitudinal crack
S102
Distinguishing between a presence of a longitudinal crack and a different defect
S104
Determining a frequency distribution of the longitudinal cracks along a broad side of the strand
S106
Determining a dynamic temperature distribution in a vertical direction of the mold
S108
Determining a change in a static temperature distribution in the vertical direction of the mold
S110
Verifying the detection of longitudinal cracks by the downstream thermal elements
S112
determining a correction value based on a spacing between thermal elements a current speed of the strand
S114
Correcting thermal element signals with respect to timing
S116

PROCESS FOR PREDICTING THE EMERGENCE OF LONGITUDINAL CRACKS DURING CONTINUOUS CASTING

PRIORITY CLAIM

This is a U.S. national stage of Application No. PCT/EP2009/000617, filed on Apr. 30, 2009, which claims priority to German Application No: 10 2008 028 481.5, filed: Jun. 13, 2008, the contents of which are incorporated herein by reference.

BACKGROUND OF THE INVENTION

1. Field of the Invention

The invention is directed to a method for predicting the occurrence of longitudinal cracks in the continuous casting of steel slabs in which the local strand temperature is measured by thermal elements arranged so as to be distributed in a mold wall.

2. Related Art

Previous methods with direct measurement and evaluation of the temperature values such as are described, for example, in JP 01210160 A or JP 62192243 A are often unsuccessful due to the high failure rate of the thermal elements and the poor connection between the tip of the thermal element and the copper of the mold. These connection problems result in signals which are very unreliable with respect to the temperature level.

On the other hand, both of the facts mentioned above give each mold its own "fingerprint" (its own pattern or identifying image). This fingerprint is characterized by deviations in the temperature level and total failures within the high quantity of thermal elements arranged in rows on the broad side and narrow side.

SUMMARY OF THE INVENTION

It is an object of the invention to provide a method for predicting the risk of longitudinal cracks.

In the continuous casting of steel, longitudinal cracks form in the cooling strand within the mold. Longitudinal cracks can be ascertained by a sharp drop in the temperature of individual thermal elements in the continuous casting mold. A greater predictive accuracy is achieved by a plurality of rows of thermal elements distributed along the height of the mold. After the initial detection, the rows of thermal elements which are subsequently passed by the strand can confirm defects and ensure the results. To this end, the thermal element signals in the different rows must be corrected with respect to timing. The correction value is given by the spacing between the rows of thermal elements and the current speed of the strand because the defect is located in a fixed manner in the strand surface.

According to one embodiment of the invention is a method for predicting the occurrence of longitudinal cracks in the continuous casting of steel slabs in which the local strand temperature is measured by thermal elements which are arranged so as to be distributed in the mold wall in that a statistical assessment of the risk of a break-out in the strand caused by a longitudinal crack is performed by taking into account the actual temperature values measured by the thermal elements arranged in the mold and based on the temperature values determined in a crack-free state.

BRIEF DESCRIPTION OF DRAWINGS

FIG. 1 is a flowchart of the method.

DETAILED DESCRIPTION OF THE DRAWINGS

In contrast to the known method, the invention works with a statistical assessment of the measured temperature values. For this purpose, two method variants can be applied.

The first variant is a model-based method, e.g., principal component analysis (PCA).

By applying a model-based method, actual temperatures are compared to a model and, therefore, information from a preceding casting.

This model is obtained from a historical data set without longitudinal cracks. The model describes the state in which the defect being looked for does not occur. Every PCA alarm is evaluated subsequently by an expert decision system based on fuzzy control, and a decision is made as to whether a longitudinal crack or some other unspecified defect is present. The expert system performs verification of PCA alarms.

This method is based on the two-step process described above.

In this case, the fault detection is carried out by a model-based method.

This model-based method compares the actual state of the installation to the normal state determined from historical data. An expert system subsequently evaluates the signals of the thermal elements arranged one above the other in a column and are passed successively by a longitudinal crack. In so doing, fault identification and fault isolation are performed. A decision is made on the basis of the temperature gradient as to whether a longitudinal crack or some other kind of defect is present.

In the other method variant, which likewise takes into account the measured temperature values, three risk factors are defined. These risk factors represent the risk of a break-out caused by a longitudinal crack. If one of these factors exceeds a certain magnitude, countermeasures against a break-out caused by a longitudinal crack are taken the next time a longitudinal crack is detected. These countermeasures can include reducing casting speed, influencing the electromagnetic brakes, or specifically changing a set value of a casting surface level.

In particular, the three factors are:

1. Frequency distribution of the longitudinal cracks along the broad side;

2. The distribution of the dynamic temperature distribution in the vertical direction of the mold considered along the broad side; and/or 3. The change in the static temperature distribution in the vertical direction of the mold considered along the broad side.

Underlying all three factors is the fact that large temperature gradients in close proximity can lead to high stresses in the circumferential direction and, therefore, to the bursting of longitudinal cracks.

With respect to the frequency distribution, the percentage of longitudinal cracks occurring at a determined position of a broad side of the mold is calculated. In so doing, the chronological sequence is also taken into account. If the criterion exceeds a determined threshold, countermeasures are introduced as soon as a longitudinal crack occurs at the broad side position of the threshold violation.

The criterion of dynamic temperature distribution in the vertical direction is characterized by an average of the dynamic variation of the thermal elements in a thermal element column. The dynamic variation is mapped, e.g., by the standard deviation or the variance of a measured value over a certain reference time period. If this calculated mean dynamic variation per thermal element column leads to sharply differing values in adjacent columns, countermeasures are adopted. These countermeasures are identical to those in the first criterion. However, the countermeasure only takes effect as soon as another longitudinal crack occurs near the position where the threshold of the second criterion was violated and the threshold of the second criterion is still exceeded when this longitudinal crack occurs.

The third criterion compares the temperature gradient formed from an upper thermal element row minus a lower thermal element row along the broad side of the mold. If the temperature gradients in adjacent columns have sharply differing values, countermeasures identical to those in the first criterion are taken as soon as a longitudinal crack occurs near this specific position and the limiting value of the third criterion is still exceeded when the longitudinal crack occurs.

The method according to one embodiment predicts an occurrence of longitudinal cracks in continuous casting of steel slabs. The temperature of a local strand is measured by thermal elements arranged in a distributed manner in a mold wall. (S100). A statistical analysis is performed of a risk of a break-out in the strand caused by a longitudinal crack based at least in part on the temperature values measured by the thermal elements arranged in the mold and temperature values determined in a crack-free state. (S102). An expert system distinguishes between the presence of a longitudinal crack or another defect. (S104). A statistical assessment determines a frequency distribution of the longitudinal cracks along a broad side of the strand. (S106). The statistical assessment determines a dynamic temperature distribution in a vertical direction of the mold along the broad side. (S108). The statistical assessment determines a change in a static temperature distribution in the vertical direction of the mold along the broad side. (S110). Downstream thermal elements verify the detection of longitudinal cracks. (S112). A correction value based at least in part on a spacing between one or more rows of thermal elements arranged in the mold and a current speed of the strand is determined (S114) and thermal element signals are corrected in the different one or more thermal element rows with respect to timing. (S116).

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention, Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for predicting an occurrence of longitudinal cracks in continuous casting of steel slabs, comprising:

measuring a temperature of a local strand by thermal elements distributed in rows and columns in a mold wall as a fingerprint for the mold; and performing a statistical assessment comprising principle component analysis of only the measured temperature values and temperature values determined in a crack-free state based on measurement and evaluation of the thermal elements, including measured data from preceding castings, to determine a risk of a break-out in the strand caused by the longitudinal crack;

the statistical assessment further comprising at least one of:

determining a frequency distribution of the longitudinal cracks along a broad side of the strand as a percentage and over time;

determining a dynamic temperature distribution in a vertical direction of the mold along the broad side of the mold by thermal elements which are arranged columnwise; and determining a change in a static temperature distribution in the vertical direction of the mold along the broad side;

the method further comprising distinguishing by an expert system between a presence of a longitudinal crack and a different defect.

2. The method according to claim 1, further comprising:

verifying the detection of longitudinal cracks by downstream thermal elements.

3. The method according to claim 2, further comprising:

determining a correction value to the thermal element signals in the different one or more thermal element rows with respect to timing based at least in part on a spacing between one or more rows of thermal elements arranged in the mold and a current speed of the strand; and correcting the thermal element signals in the different one or more thermal element rows with respect to timing based on the correction value.

4. A method for predicting an occurrence of longitudinal cracks in continuous casting of steel slabs, comprising:

measuring a temperature of a local strand by thermal elements distributed in a mold wall;

determining whether a longitudinal crack is potentially present based on the temperatures measured by the thermal elements and temperature values determined in a crack-free state;

determining a correction value for downstream thermal elements with respect to timing based at least in part on a spacing between one or more rows of thermal elements arranged in the mold and a current speed of the strand;

correcting thermal element signals in the rows of downstream thermal elements with respect to timing based on the correction value;

verifying the detection of the longitudinal crack by the downstream thermal elements based on the corrected thermal element signals from the downstream thermal elements; and performing a statistical assessment comprising principal component analysis of only the measured temperature values and temperature values determined in a crack-free state to determine a risk of a break-out in the strand caused by the longitudinal crack.

5. The method according to claim 4, further comprising:

confirming by an expert system the detection of a longitudinal crack.

6. The method according to claim 5, comprising:

determining by the expert system whether a longitudinal crack or another defect is present.

7. The method according to claim 4, wherein the statistical assessment further comprises at least one of:

determining a frequency distribution of the longitudinal cracks along a broad side of the strand;

determining a dynamic temperature distribution in a vertical direction of the mold along the broad side; and determining a change in a static temperature distribution in the vertical direction of the mold along the broad side.

* * * * *